US005778988A

United States Patent [19]

Ilomäki

[11] Patent Number: 5,778,988

[45] Date of Patent: Jul. 14, 1998

[54] DRILLING APPARATUS

[76] Inventor: Valto Ilomäki, Loilantie 8, FIN-33470 Ylöjärvi, Finland

[21] Appl. No.: 637,626

[22] PCT Filed: Oct. 27, 1994

[86] PCT No.: PCT/FI94/00486

§ 371 Date: Apr. 29, 1996

§ 102(e) Date: Apr. 29, 1996

[87] PCT Pub. No.: WO95/12040

PCT Pub. Date: May 4, 1995

[30] Foreign Application Priority Data

Nov. 27, 1993 [FI] Finland ..... 934741

[51] Int. Cl.[6] ..... E02F 5/18; E21B 7/20

[52] U.S. Cl. ..... 173/141; 173/4; 173/147; 173/154

[58] Field of Search ..... 173/4, 9, 11, 39, 173/42, 147, 154, 141; 299/55, 56; 175/62, 122, 171

[56] References Cited

U.S. PATENT DOCUMENTS

| | | | |
|---|---|---|---|
| 2,143,105 | 1/1939 | Curtis | 173/147 |
| 2,665,117 | 1/1954 | Ivey | 173/147 |
| 3,612,195 | 10/1971 | Rich | 173/154 |
| 3,682,261 | 8/1972 | Bird | 173/147 |
| 4,161,990 | 7/1979 | Forsberg et al. | 173/147 |
| 5,050,688 | 9/1991 | Patterson | 173/147 |
| 5,355,965 | 10/1994 | Rozendaal | 173/147 |

*Primary Examiner*—Scott A. Smith
*Attorney, Agent, or Firm*—Larson & Taylor

[57] ABSTRACT

Drilling apparatus which comprises support structure mounted guide tracks which extend in a drilling direction. A rotating and pushing unit is mounted on said guide tracks for movement in the drilling direction. The apparatus is provided with a series of members for adjusting the height of the rotating and pushing unit in relation to the guide tracks, the members extending in the drilling direction and allowing the rotating and pushing unit to glide in the drilling direction.

7 Claims, 2 Drawing Sheets

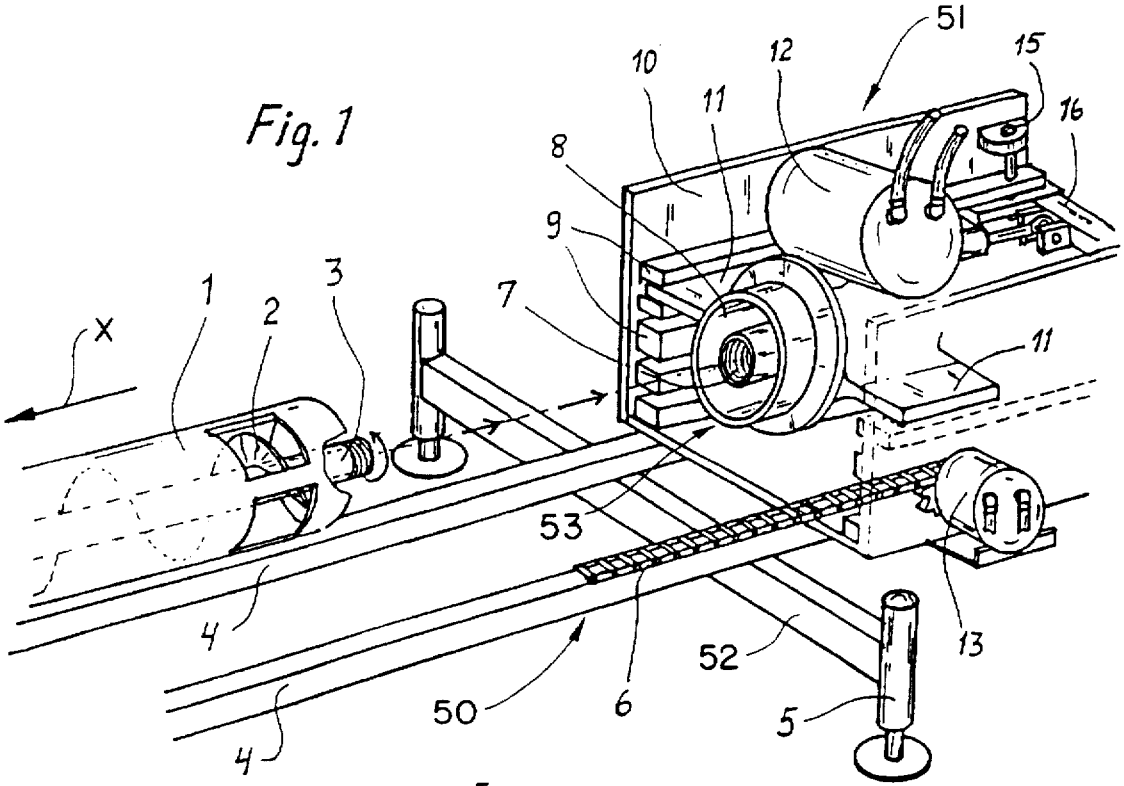
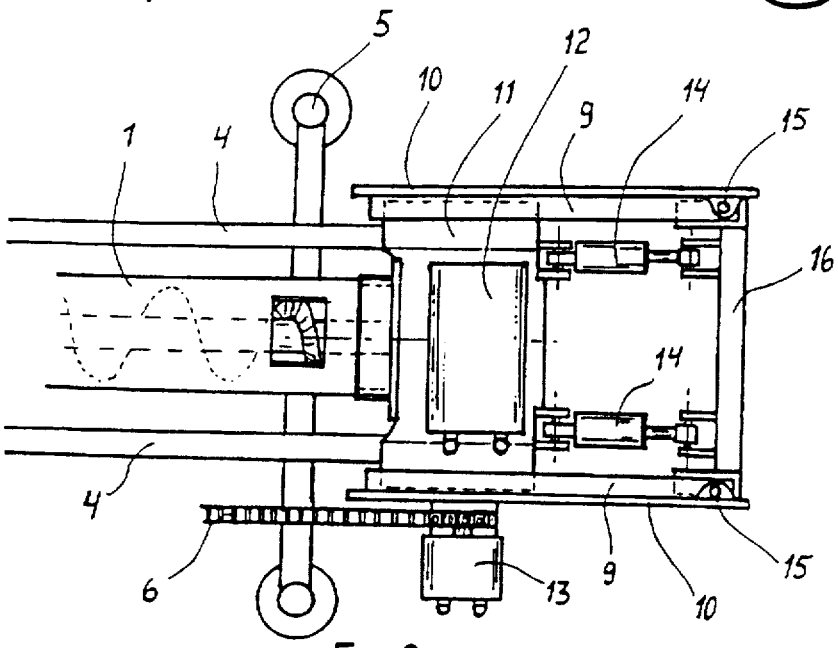
Fig.2

DRILLING APPARATUS

BACKGROUND OF THE INVENTION

This invention relates to a drilling apparatus which has an advancing unit comprising a drilling pipe rotating and pushing unit the height of which latter unit is adjustable in relation to guide tracks of the base frame in accordance with the diameter of the drilling pipe. Such adjustment permits the lower surface of the drilling pipe to be positioned at the same height in relation to the guide tracks of the base frame irrespective of the pipe diameter.

Previously known drilling apparatus which drill in a horizontal direction have a support for rotating and pushing a drilling pipe into soil at the front end of the guide tracks of which there are provided height adjustable supports for different pipe diameters, and the rotating and pushing units supports the drilling pipe such that the pipe center is always located at the same height above the guide tracks in spite of different pipe diameters.

When several side by side holes are drilled with this previously known construction, the support at the front end of the guide tracks has to be adjusted to different heights when changing the pipe diameter in order to align the drilling pipe with the guide tracks. Also in the rotating and pushing unit, the rotating center has to be positioned according to the largest pipe diameter. This causes maximum strain against the base construction because the lever arm of the pushing force is always of the same maximal length when using all sizes of the pipe diameter. This causes bending strain on the base guide tracks and hard strain on the bearing surface between the advancing unit and guide tracks.

These disadvantages can be avoided according to the invention.

The most important advantage for the invention is that there is in the advancing unit a supporting construction for the various sizes of drilling pipes which can be easily mounted at an appropriate level corresponding to a particular pipe diameter. The lower surface can always be positioned at the same height above the guide tracks. Accordingly, it is not necessary to adjust the position of the guide tracks even though the pipe diameter size changes. Also the lever arm which strains the advancing unit and the base frame when a drilling pipe is pushed is always the shortest possible.

BRIEF DESCRIPTION OF THE DRAWINGS

In the following the invention is described more closely referring the enclosed drawing where:

FIG. 1 is a diagrammatic perspective view of drilling apparatus in accordance with the invention;

FIG. 2 is a diagrammatic top view of the drilling apparatus of FIG. 1;

DESCRIPTION OF PREFERRED EMBODIMENTS

Figure 3:
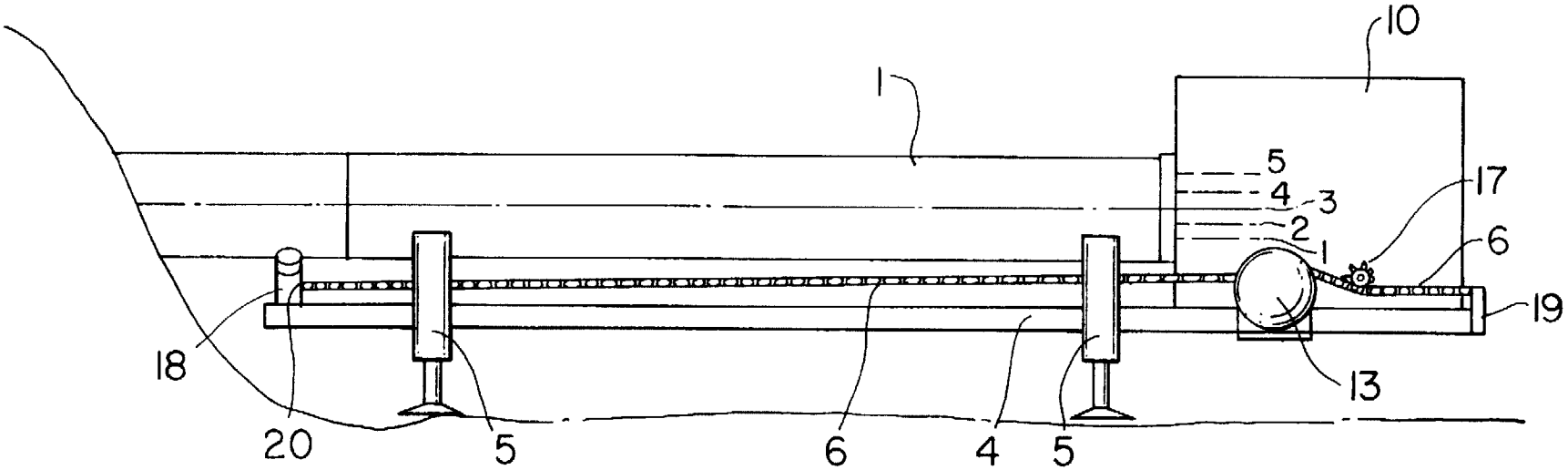
FIG. 3 is a diagrammatic side elevation view of the drilling apparatus of FIG. 2.

In FIG. 1 there are guide tracks 4 mounted on an adjustable frame 50 on which tracks an advancing unit 51 is moved during drilling. Cylinders 5 are provided for adjusting the height of crosswise beam 52 in the frame. The advancing unit 51 comprises a housing 10 which is partly like a box, having a bottom and side walls. Supports 9 are fixed to the inner surfaces of the side walls of the housing 10 at different heights. A rotating and pushing unit 53 is mounted on supports 9 by sideways-directed lever plates 11 inserted between supports 9 with a clearance which allowing gliding. The rotation and pushing unit 53 has a hydraulic motor 12 as a rotating device which motor rotates by means of a herringbone gear a pipe coupling 7 which is located in the center of a pushing part 8. In use, a drilling pipe 1 comprising conveyor spiral 2 and center pipe 3 is fixed to pipe coupling 7 as shown in FIG. 2. Pressurized air is lead via center pipe 3 to a drill bit (not shown) in the drill head (not shown). The pipe 1 is pushed by means of pushing part 8 when the whole advancing unit is moved in the drilling direction (shown by arrow "X") on the guide tracks 4. A hydraulic motor 13 and a chain 6 is used for moving the advancing unit.

In general, only certain pipe sizes are used in drilling. The height level of the supports 9 is selected according to the size of a chosen pipe such that the lower surface of the drilling pipe is located essentially at the same height level above guide tracks 4 irrespective of the pipe diameter when the rotating and pushing unit 53 is mounted on the supports 9 which correspond to the diameter in question. When the pipe diameter is changed, the pushing part 8 is also changed to apply to the pipe. The rotating pipe coupling 7 is generally the same for all sizes of the pipes 1. The drilling pipe 1 has openings 2 for discharging drill waste.

As shown in FIG. 2, rotating and pushing unit 53 is secured in the longitudinal direction to the housing 10 of the advancing unit 51 by means of cylinders 14. The cylinders are fixed at their other end to a crosswise beam 16. The crosswise beam 16 is locked by means of pins 15 in the ends of support members 9 at a desired height. The ends of the supports 9 have holes in vertical alignment and each pin 15 is as long as each line of aligned holes.

Cylinders 14 are used during drilling for sensing the pushing force. The pressure generated in the cylinders is used to control the pressure or flow which is lead to the motor 13. Pressure increase in the cylinders 14 stops the advancing motion of motor 13 and pressure decrease in the cylinders controls pressurized flow to motor 13.

As shown in FIG. 3, chain 6, which is fixed at points 19 and 20, provides movement of advancing unit 53 both forwards and backwards by means of motor 13. A member 18 located at the front end of the guide tracks for supporting the drilling pipe is not needed to be adjusted when the pipe diameter is changed.

Also many other types at support members 4 can be used provided that they allow gliding motion in the longitudinal drilling direction and that they can accommodate the torsion moment induced by drilling.

What is claimed is:

1. Drilling apparatus comprising:

a support frame having guide tracks extending in a drilling direction;

a drilling pipe advancing unit mounted for movement in a drilling direction on said guide tracks;

a drilling pipe rotating and pushing unit mounted on said advancing unit for movement therewith and comprising a member for pushing a drilling pipe in said drilling direction, means for coupling a drilling pipe to said pushing member, and means for rotating a drilling pipe coupled to said pushing means;

means for moving said advancing unit in said drilling direction; and means for mounting said pipe rotating and pushing unit on said advancing unit, said mounting means comprising means for adjusting the height of said pushing and advancing unit relative to said guide tracks, said mounting means comprising a plurality of elongate support members mounted on said advancing unit and extending in said drilling direction, said elongate support members allowing said rotating and pushing unit to glide thereon in said drilling direction.

2. Apparatus according to claim 1 wherein said height adjusting means allows the rotating and pushing unit to be mounted on said advancing unit such that when a drilling pipe is coupled to said pushing member, the lower surface of a drilling pipe can be positioned at essentially the same height above said guide tracks irrespective of the diameter of the drilling pipe.

3. Apparatus according to claim 2 wherein said mounting means comprises a plurality of vertically spaced apart pairs of elongate support members, the support members of each of said pairs being spaced apart in a direction transverse to said drilling direction.

4. Apparatus according to claim 1 further comprising means for sensing a pushing force applied to a drilling pipe by said pushing member.

5. Apparatus according to claim 4 wherein said force sensing means comprises a hydraulic cylinder mounted on said rotating and pushing unit and secured to a fastening point on said advancing unit.

6. Apparatus according to claim 5 wherein said hydraulic cylinder sensing means further comprises means for vertically adjusting said fastening point.

7. Apparatus according to claim 3 wherein said pairs of elongate support members are constructed and arranged to prevent rotation of said rotating and pushing unit.

* * * * *